United States Patent [19]

Hoefer

[11] 4,020,563

[45] May 3, 1977

[54] SLAB GEL DRYER AND METHOD

[75] Inventor: Stanton A. Hoefer, San Francisco, Calif.

[73] Assignee: Hoefer Scientific Instruments, San Francisco, Calif.

[22] Filed: Apr. 21, 1975

[21] Appl. No.: 569,838

[52] U.S. Cl. ..... 34/48; 34/92; 219/243; 219/460

[51] Int. Cl.[2] ..... F26B 19/00

[58] Field of Search ..... 34/16, 48, 92, 15; 219/243, 385, 460; 264/101, 102, 349

[56] References Cited

UNITED STATES PATENTS

| | | | |
|---|---|---|---|
| 1,671,493 | 5/1928 | Staege | 34/48 |
| 2,653,394 | 9/1953 | Nelson et al. | 219/243 |
| 2,661,543 | 12/1953 | Tyndall et al. | 34/16 |
| 3,176,409 | 4/1965 | McKeever | 34/16 |
| 3,202,278 | 8/1965 | Taylor | 206/471 |
| 3,253,348 | 5/1966 | Oderman | 34/92 |
| 3,253,351 | 5/1966 | Bettanin | 34/92 |
| 3,460,266 | 8/1969 | Fleissner | 34/48 |
| 3,889,389 | 6/1975 | Serup | 34/92 |

*Primary Examiner*—John J. Camby
*Assistant Examiner*—Larry I. Schwartz
*Attorney, Agent, or Firm*—Flehr, Hohbach, Test, et al.

[57] ABSTRACT

An apparatus for drying slab gels having a metal platen with electrical strip heaters mounted on one side thereof and a depression formed in the other side which serves as a drying chamber. The slab gel is laid on a sheet of porous filter paper over which is laid a sheet of non-porous material having non-adhesive qualities relative to the slab gel. The mounted and covered slab gel is placed in the depression and a compliant cover sheet is placed over the top of the depression overlapping the platen around the periphery of the depression. An open passage is formed through one edge of the platen in communication with the depression therein. The strip heaters are connected to an electrical power source and the open passage is connected to a vacuum source. The pressure in the depression is reduced relative to ambient pressure causing the compliant cover to be forced against the platen around the periphery of the depression for sealing the drying chamber. Moisture vaporized from the slab gel is removed through the open passage. A thermostat may be used to control the temperature of the platen and a timer may be used to provide for a predetermined period of heating and evacuation of the drying chamber. A temperature sensor may be placed in intimate contact with the slab gel for producing a signal to a relay for interrupting heater power when slab gel temperature rises through a predetermined temperature after substantially all of the moisture content has been vaporized from the slab gel.

11 Claims, 7 Drawing Figures

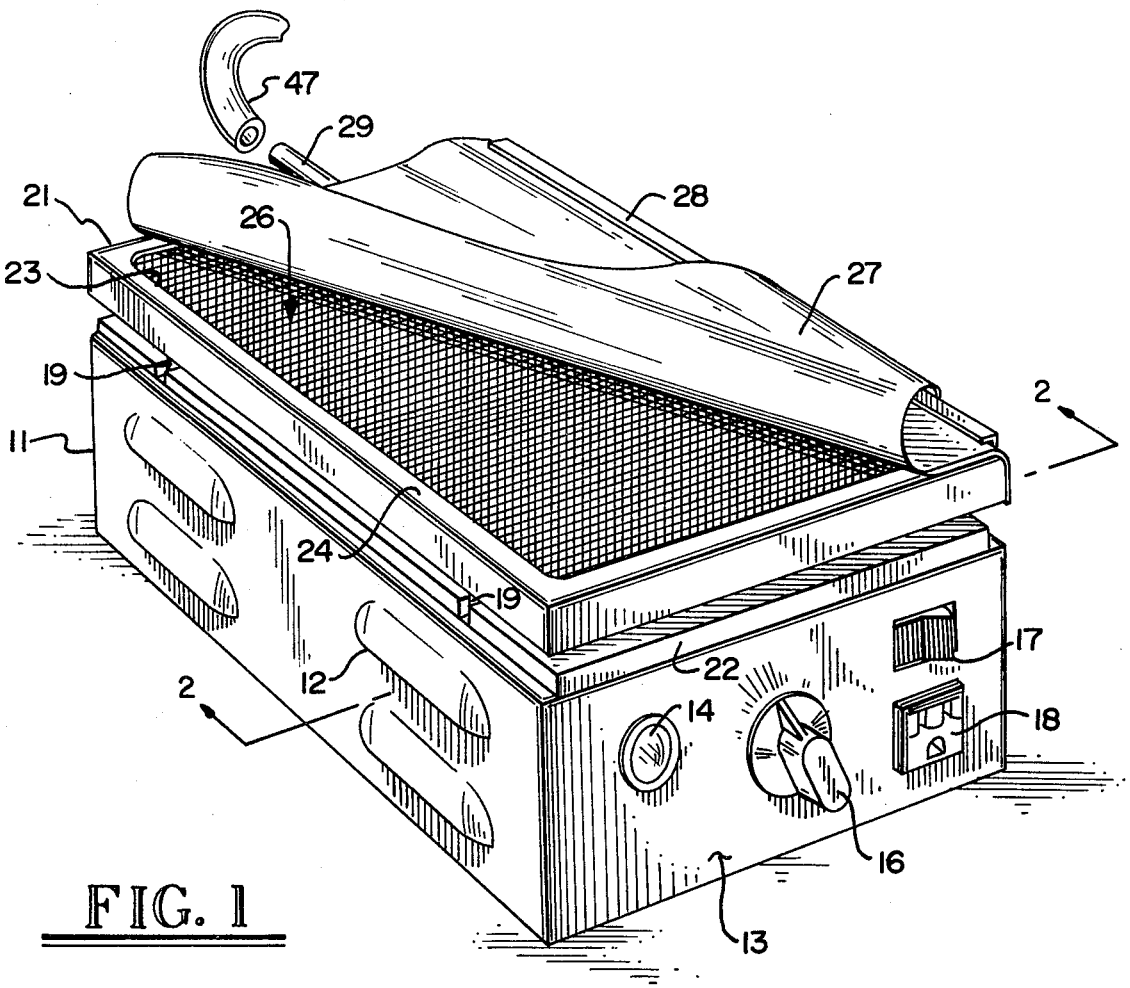
FIG. 1
FIG. 4
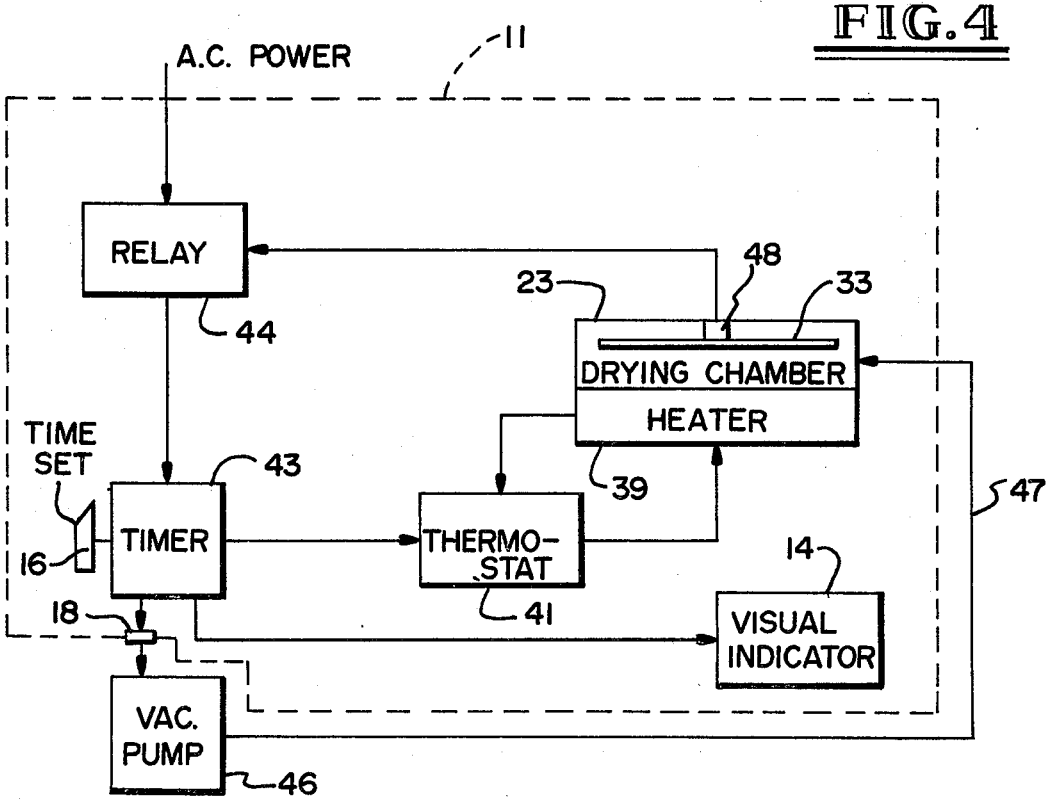

SLAB GEL DRYER AND METHOD

BACKGROUND OF THE INVENTION

This invention relates to apparatus for drying slab gels and more particularly to such apparatus for preparing slab gels for storage and future analysis.

In the past slab gels have been dried on glass plates merely by exposing the spread slab gel to ambient air. Such a method produces a dried slab gel after considerable time which adheres to the glass plate. Distortion and cracking of the drying slab gel generally occur due to the non-uniform drying rate throughout the slab over the prolonged drying period. In an attempt to avoid distortion and fracture during dehydration a sandwich drying scheme has been utilized involving placement of the slab gel between a filter paper and some removable film. The filter paper-slab-removable film sandwich is in turn placed between a porous polyethylene sheet and a screen providing mechanical support for the assembly. On each side of the layered assembly a silicone rubber sheet is positioned, both rubber sheets having edges which extend beyond the edges of the layered assembly. The extending edges of the rubber sheets are sealed together and a tube is inserted through one rubber sheet through which a vacuum is drawn within the silicone rubber envelope. The entire sealed sandwich is emersed in boiling water to provide heat for vaporizing moisture from the slab gel while the vacuum removes the moisture from the inside of the rubber envelope until the slab gel is dehydrated. Considerable time is still necessary for slab gel dehydration utilizing the evacuated sandwich method.

Apparatus is needed for dehydrating slab gels without distortion or fracture, in a relatively short period of time and utilizing a method which is easy to perform without complex steps and complicated equipment.

OBJECTS AND SUMMARY OF THE INVENTION

In general the apparatus disclosed herein includes a support frame upon which is mounted a platen having a drying chamber formed on one side. Means are mounted adjacent the other side of the platen for heating the platen and thereby the drying chamber. Slag gel support means is formed for positioning within the drying chamber. A cover is laid over the drying chamber extending over the platen surrounding the periphery of the drying chamber. A vacuum source is placed in communication with the drying chamber for reducing the chamber internal pressure relative to ambient pressure. When the drying chamber is evacuated ambient pressure forces the cover against the platen about the periphery of the drying chamber thereby providing a chamber seal. Moisture vapor driven from the slab gel by the heat within the chamber is removed from chamber by the vacuum means.

The method includes placing a slab gel on a supporting member. The mounted slab gel is thereafter placed in a drying chamber and the drying chamber is covered. The drying chamber is then heated and the temperature within the chamber is controlled. The drying chamber is thereafter evacuated, thus effecting a seal of the covered drying chamber due to the force resulting from the pressure differential across the cover and also removing moisture vapor from within the chamber. The heating period is timed and both the heating and evacuation of the drying chamber are interrupted after a predetermined period of time.

It is an object of the present invention to provide a slab gel dehydration apparatus which reduces drying time.

It is another object of the present invention to provide a slab gel dehydration apparatus which produces dried slab gels without distortion or fracture.

It is another object of the present invention to provide a slab gel dehydration apparatus allowing a simple easily performed slab gel drying process.

It is another object of the present invention to provide a slab gel dehydration apparatus with automatic drying time and drying chamber temperature control.

It is another object of the present invention to provide a slab gel dehydration apparatus for terminating a drying cycle at the point when substantially all moisture has been removed from the slab gel.

It is another object of the present invention to provide a slab gel dehydration apparatus utilizing dry heating for reduction of dehydration time.

Additional objects and features of the invention will appear from the following description in which the preferred embodiment has been set forth in detail in conjunction with the accompanying drawings.

BRIEF DESCRIPTION OF THE DRAWINGS

FIG. 1 is an isometric view of the slab gel dehydration apparatus.

FIG. 4 is a block diagram of the apparatus of FIG. 1.

DESCRIPTION OF THE PREFERRED EMBODIMENTS

Figure 2:
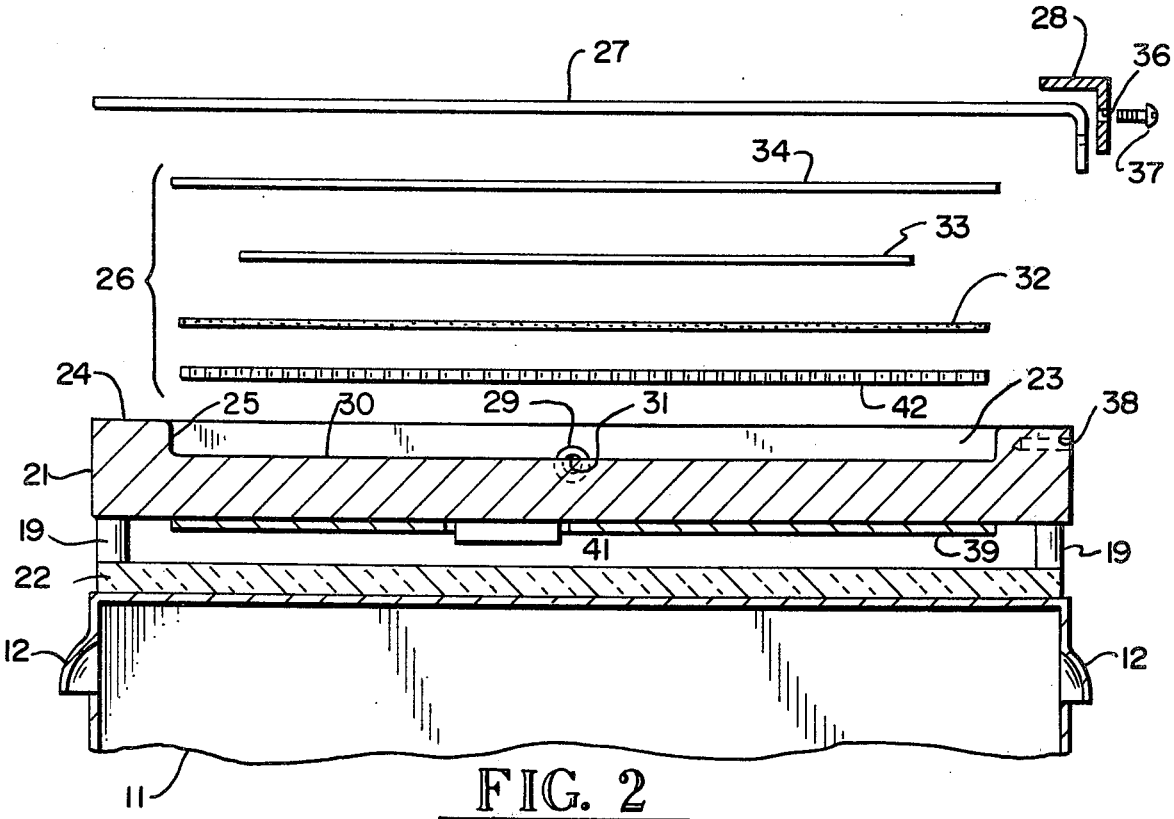
FIG. 2 is a sectional elevation view taken along the line 2—2 of FIG. 1.

FIG. 1 shows an isometric view of the slab gel dryer for dehydrating slab gels. The slab gels provide a means for sample analysis and medical diagnosis. The slab gels are prepared utilizing devices and methods such as described in co-pending patent application for a VERTICAL GEL SLAB ELECTROPHORESIS APPARATUS AND METHOD, Ser. No. 455,871, filed Mar. 28, 1974 now U.S. Pat. No. 3,932,265, and the SLAB GEL DIFFUSION DESTAINER AND METHOD, Ser. No. 452,076, filed Mar. 18, 1974 now U.S. Pat. No. 3,930,880. The slab gel dryer is then utilized to mount the slab gel on a supporting member and to remove the moisture therefrom without distorting or fracturing the slab gel. A lower support frame 11 has side louvers 12 formed therein for allowing air circulation through the lower support frame 11 to prevent a build-up of heat therein. A front control panel 13 is fashioned on lower support frame 11 containing a visual indicator light 14, a time setting knob 16, a power on-off switch 17, and a timed power outlet receptacle 18. Receptacle 18 may be positioned on any side of lower support frame 11 which proves convenient. Power on-off swtich 17 may be eliminated and power actuation obtained through timer setting knob 16.

Lower support frame 11 has a plurality of stand-offs 19 extending outwardly therefrom for supporting a platen 21 spaced above support frame 11. A sheet of poor thermal conducting material, such as asbestos board, is disposed in the space between platen 21 and lower support frame 11 to form a heat shield 22 therebetween.

A drying chamber appearing in this embodiment as depression 23 is formed on one side of platen 21. A continuous peripheral surface 24 remains on the one side of platen 21 which surrounds depression 23. Structure shown generally at 26 is formed for placement within the drying chamber or depression 23 which serves to support the slab gels. A cover 27 which may be formed of some compliant material, such as a sheet of silicone rubber, is formed to overly depression 23 and to extend beyond the edges thereof, thereby overlapping the peripheral portion 24 of platen 21. Cover 27 is fastened along one edge to platen 21 by some means such as angle clamp 28. A tube 29 extends through platen 21 having an air passage therethrough for communicating drying chamber 23 with an external environment.

Figure 3:
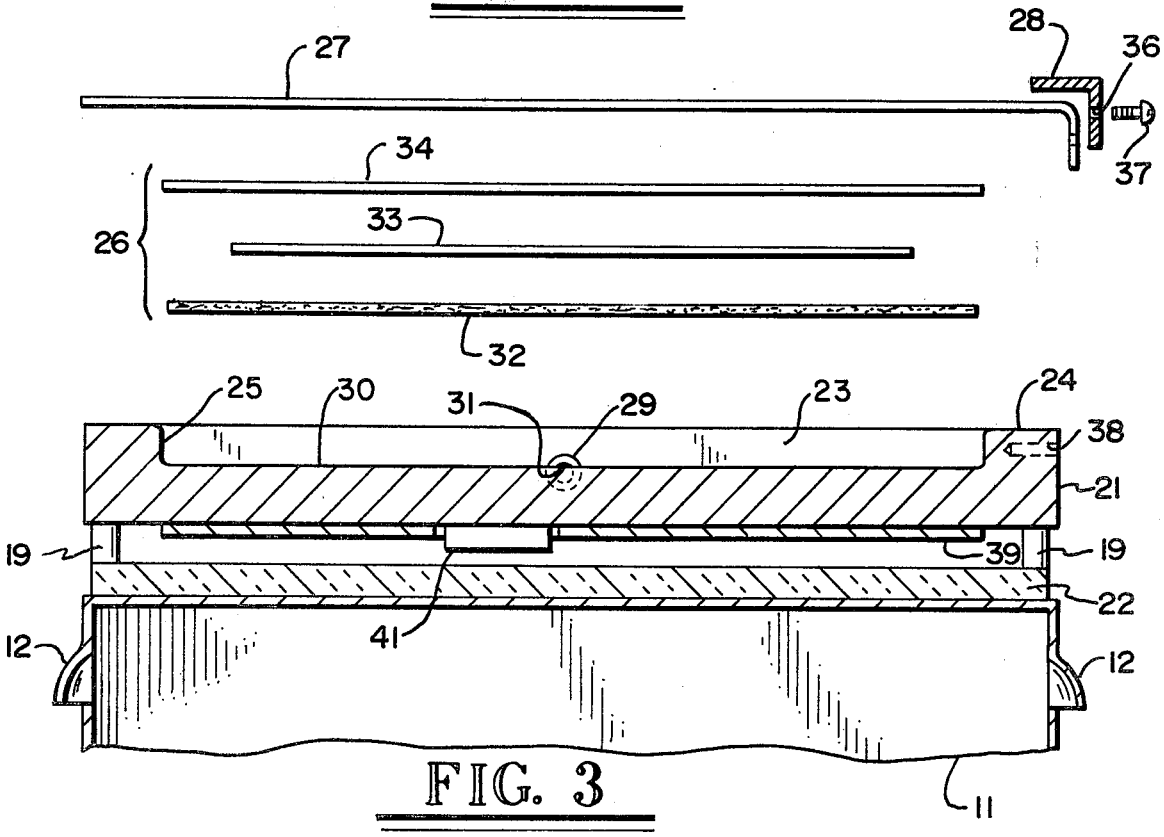
FIG. 3 is a sectional elevation view of another embodiment of the apparatus shown in FIG. 1.

Turning now to FIG. 3 one embodiment of the disclosed invention is shown in section. Lower support frame 11 is shown supporting platen 21 by means of stan-offs 19. Drying chamber 23 has boundaries including side walls 25 and a bottom surface 30. Drying chamber 23 has tube 29 passing through one boundary thereof thus forming an air passage 31 for the above-referenced communication with an external environment.

Structure 26 for supporting slab gels is shown in exploded view overlying drying chamber 23 and having dimensions allowing placement within the drying chamber 23. Structure 26 includes a heavy-body porous filter paper 32 upon which is laid the moisture laden slab gel 33. A slab overlay sheet 34 is fabricated of some material which will not adhere to the slab gel 33 as the slab gel is dried. A wide selection of smooth surfaced plastic sheeting is available for use as over-lay sheet 34. Cover 27 has a dimension for overlying peripheral area 24 on platen 21. Cover 27 is fastened to one edge of platen 21 by means of angle clamp 28 having clearance holes 36 therethrough. Screws 37 are formed to pass through holes 36 as well as cover 27 to enter threaded holes 38 in platen 21 for securing clamp 28 and thereby cover 27 to one edge of platen 21. Platen 21 may have a roughened or channeled bottom boundary 30 for providing substantially uniform dispersal of pressure across the underside of filter paper 32.

On the other side of platen 21, FIG. 3 shows an electrical strip heater 39 attached to platen 21. Strip heater 39 is electrically energized and platen 21 is of some thermally conductive material, such as aluminum, for conducting heat to drying chamber 23 for elevating the temperature therein. Strip heater 39 may have a thermostat 41 operating in conjunction therewith. Thermostat 41 is shown in contact with the side of platen 21 on which strip heaters 39 are located. Thermostat 41 is capable of adjustment to a predetermined temperature for controlling the heat energy provided by strip heaters 39 and thereby the temperature in drying chamber 23.

Reference is now made to FIG. 2 which is similar to FIG. 3 is all respects except one. In many cases the relative thickness of filter paper 32 and slab gel 33 is such that filter paper 32 provides ample support for slab gel 33 without distortion or fracture of the slab gel occurring during drying and subsequent handling. In certain circumstances slab gel 33 may be relatively thick compared to filter paper 32, in which case an additional support member in the form of a screen 42 is required to provide additional rigidity for slab gel 33 during the drying and handling processes. In such an instance, filter paper 32 must yet maintain a minimum thickness to prevent malforming of the slab gel by the screen in this embodiment. Screen 42 may be required for spacing the underside of filter paper 32 from the bottom boundary 30 of drying chamber 23. Such spacing must be minimized so that structure 26 is not isolated from heat conducted through platen 21. The spacing provides uniform dipsersal of pressure across the underside of filter paper 32 whereby bottom boundary 30 may be smooth.

Referring now to FIG. 4, a block diagram of the slab gel dryer is shown. The embodiment of FIG. 4 shows a timer 43 Thermostat receiving power through a means for interrupting the power such as relay 44. Timer 43 is set for passing power therethrough for a predetermined time period by means of time setting knob 16. Timer 43 connects power for the predetermined period of time to the timed power outlet receptacle 18 and to a vacuum pump 46. Vacuum pump 46 is connected through appropriate tubing 47 to tube 29, whereby a vacuum source is communicated with drying chamber 23 through air passage 31. Timer 43 also delivers power through thermostat 41 to heater 39 for the predetermined period of time. Thermostate 41 may be of the type which interrupts power to heater 39 at a predetermined temperature level, thereby controlling the heat energy delivered to drying chamber 23 and the temperature level therein. The timed period set by timer control knob 16 is indicated by visual indicator 14. Visual indicator 14 may be an indicator light which glows during the time period.

The roughened bottom boundary 30 in drying chamber 23 or the screen 42 assist in obtaining undistorted fracture free dried slab gels 33. Uniform exposure of the under side of filter paper 32 draws moisture from slab gel 33 substantially uniformly. Resulting contraction of slab gel 33 due to moisture loss is therefore uniform throughout the slab gel, which avoids slab gel distortion and fracture during dehydrations.

Figure 5:
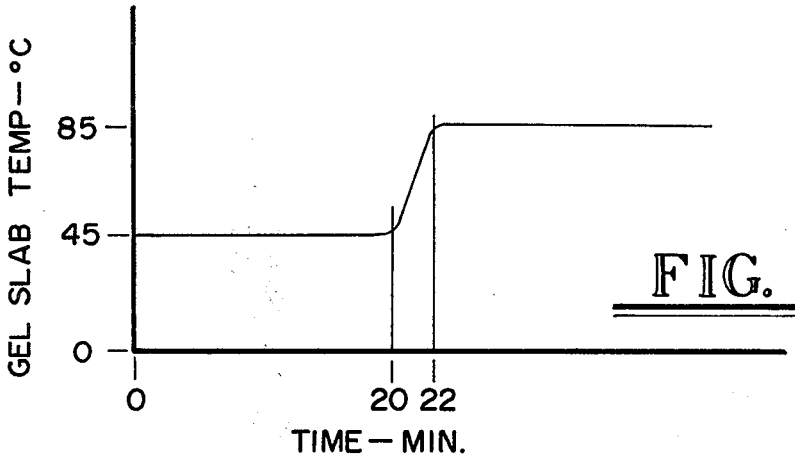
FIG. 5 is a graph of a typical gel slab temperature as a function of time.

Native gels with homogenous consistency have generally a uniform moisture content throughout. This feature may be utilized to provide an additional control in the slab gel dryer when the slab gel is dried uniformly. A temperature sensor 48 may be placed in intimate contact with the drying slab gel. For example, the temperature sensor 48 may be positioned on the underside of slab overlay sheet 34. Temperature sensor 48 produces an output signal indicative of the temperature of the slab gel 33. The output signal from temperature sensor 48 is connected to relay 44. In this fashion as the slab gel dries the temperature of the slab gel is maintained at a relatively constant level below the controlled temperature of the drying chamber 23 by the heat loss due to vaporization of moisture from slab gel 33. This feature is shown in FIG. 5 which is typical for a 0.75mm thick slab gel dried in the disclosed slab gel dryer. The temperature of the gel slab stays at approximately 45° C for about 20 minutes at which point substantially all of the moisture has been vaporized from the slab gel 33 and it is substantially dry. In approximately the following two minutes the temperature of the slab gel 33 rises from the drying temperature of 45° C to the dry temperature of 85° C. The temperature of the drying chamber 23 is represented by the 85° C temperature in this embodiment. Upon reaching a predetermined temperature level such as the 85° level, the temperature sensor 48 provides a signal level indicative of slab gel temperature which opens relay 44 interrupting power to timer 43, thereby shutting off heater 39 and vacuum pump 46.

Figure 6:
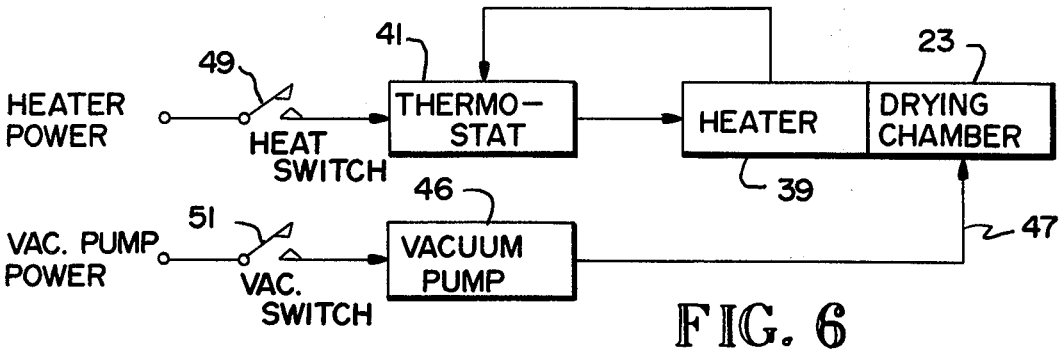
FIG. 6 is a block diagram of another embodiment of the slab gel dehydration apparatus.

Another embodiment of the present invention is shown in FIG. 6 in which heater power is provided to thermostat 41 and subsequently to heater 39 for heating drying chamber 23 through a heat switch 49. Vacuum pump power is provided to vacuum pump 46 for removing vaporized moisture from drying chamber 23 through a vacuum pump power switch 51. The embodiment of FIG. 6 is entirely manual except for the thermostatic control provided for heater 39 to control the temperature in drying chamber 23 to a level which is non-destructive for the particular slab gel 33 being dried.

Figure 7:
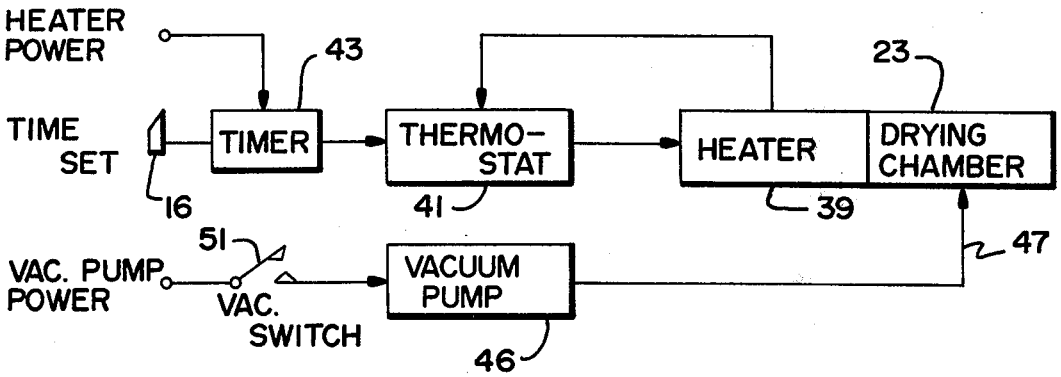
FIG. 7 is a block diagram of an additional embodiment of the slab gel dehydration apparatus.

FIG. 7 is an additional embodiment of the disclosed invention in which the timer 43 as set by timer control 16 provides heater power to heater 39 through thermostat 41 for a predetermined period of time. Vacuum pump 46 is electrically energized through manually controlled switch 51 for removing vaporized moisture from drying chamber 23 as described above.

The combination of cover 27, when fabricated of a compliant material such as silicone rubber, with the depth of depression 23, together with the configuration of the junction between side walls 25 and bottom boundary 30 of depression 23 are an important set of considerations if an adequate seal is to be obtained between cover 27 and peripheral area 24 when vacuum pump 46 is communicated with drying chamber 23. It may be seen that if depression 23 is allowed to assume too great a depth, cover 27 will assume a "wrinkled" shape with vacuum applied to chamber 23 which will allow the seal to be broken at the periphery of the chamber. The top edges of side walls 25 should have a smooth radius to avoid excess friction between the top edges and cover 27. The junction between side walls 25 and bottom boundary 30 has a predetermined radius. The seal line is found to be along the predetermined radius and a portion of side walls 25. It has been found that when cover 27 is fabricated of 1/32 inch thick silicone rubber sheet, the depth of drying chamber 23 is optimally between ⅛ and ¼ inch and the radius between side wall 25 and bottom boundary 30 of depression 23 is approximately 1/16 inch. These dimensions allow the slab gel together with a supporting stucture 26 to be placed within the depression 23 and the cover 27 to be laid thereover. A vacuum is drawn within drying chamber 23 by communicating vacuum pump 46 therewith, and a seal is formed along the aforementioned seal line by the force on cover 27 caused by the differential pressure across cover 27.

Cover 27 may be a rigid material with a peripheral gasket (not shown) for contact with peripheral area 24 when closed. Peripheral differential across cover 27 will effect a seal in a fashion similar to that described above for the instance where cover 27 is a compliant silicone rubber sheet.

One manner in which the apparatus disclosed herein may be used for dehydrating slab gels involves setting thermostat 41 to control heater 39 to provide a predetermined temperature within drying chamber 23. A useful temperature has been found to be 85° C for many applications. When a timer 43 is available in the assembly a predetermined period of time may be selected at control knob 16 for connecting power through thermostat 42 to heater 39. The timer 43 may also be used to provide power for the predetermined period of time through receptacle 18 to the vacuum pump 46 for removing vaporized moisture from drying chamber 23 during the heating or drying period. Slab gels having 0.75mm thickness have been completely dehydrated in 20 minutes time. Slab gels of 1.5mm thickness require one hour for dehydration. Slab gels of 3mm thickness require 1.5 to 2 hours dehydration time.

Upon the completion of dehydration of the slab gels 33, the gel is found to adhere to the porous filter paper 32 serving as a base. The plastic overlay sheet 34 is easily peeled from the other side of slab gel 33 since there is no adhesion therebetween. Alternatively, plastic overlay sheet 34 may be transparent and may be left in place to afford handling protection while the slab gel 33 is observed therethrough. Porous filter paper 32 may take the form of a transparent porous material, such as porous cellophane. When filter 32 is transparent and is combined with a transparent overlay sheet 34, the slab gel 33 may be subjected to visual or optical analysis. The dehydrated slab gel 33 is thus readied for storage, analysis, partition or future rehydration and analysis as desired.

A gel slab dryer has been disclosed which utilizes dry heat for reducing drying time and which produces flatter dehydrated slab gels free of distortion and fractures due to the additional rigidity provided by the heating platen together with the slab gel supporting structure. The method involved provides a more convenient approach to dehydration of slab gels compared to prior methods available. The heating platen is protected from caustic elements which may be present in slab gels by a protective coating applied to the surfaces of the drying chamber. Such a coating may be provided by a non-porous coat of FEP (Trademark) plastic protective coating which is inert to corrosive elements contained in the slab gels.

What is claimed is:

1. An appartus for dehydrating slab gels comprising a porous filter sheet for contacting the slab gel on one side thereof, an overlay sheet for contacting the slab gel on the other side thereof, said overlay sheet having a smooth non-porous surface thereby being nonadherent to the slab gel, a platen, said platen having a depression formed on one side having boundaries including a bottom with a predetermined area for receiving said overlay and porous filter sheets, a compliant cover overlaying said depression and having a size greater than said predetermined area, said depression having an opening through one boundary thereof, means for communicting a vacuum source with said opening for producing low pressure in said depression, means for uniformly supporting and for providing substantially uniform dispersal of said low pressure over the side of said porous filter sheet facing said bottom boundary, and a heater disposed on the other side of said platen, so that when the slab gel is placed between said overlay and porous filter sheets and disposed in said depression and low pressure is induced therein, ambient pressure forces said compliant cover against the periphery of said depression thereby providng providing seal therebetween and said overlay sheet holds the slab gel firmly against said porous filter sheet, whereby moisture in the slab gel is vaporized by said heater and removed from said depression through said opening and the slab gel is fixed onto said porous filter sheet in a dehydrated condition.

2. An apparatus as in claim 1 wherein said means for uniformly supporting comprises a screen having a plurality of holes therethrough for passing the vaporized moisture, said screen being disposed between said porous filter sheet and said bottom boundary of said depression, whereby the slab gel is supported during dehydration without fracturing or distorting the slab gel.

3. An apparatus as in claim 1 together with means for electrically actuating said heater, a thermostat, said thermostat being in electrical contact with said means for actuating and in thermal contact with said platen and having a preset control temperature, whereby said platen temperature is controlled at substantially said control temperature.

4. An apparatus as in claim 1 together with means for timing a period for energizing said heater, said means for timing being adjustable over a predetermined time range, whereby the slab gel may be dehydrated for said period within said predetermined time range.

5. An apparatus as in claim 4 wherein the vacuum source is electrically actuated, together with an electrical connection between said means for timing and the vacuum source, whereby vaporized moisture is removed from said depression for said period.

6. An apparatus as in claim 1 together with means for electrically actuating said heater, a temperature sensor mounted adjacent to the slab gel, said temperature sensor providing a first signal level indicative of the wet temperature of the slab gel and a second signal level indicative of the dry temperature of the slab gel, and means for disconnecting said means for electrically actuating from said heater, said means for disconnecting being responsive to said second level.

7. An apparatus for drying slab gels comprising a support frame, a platen supported on said support frame and having a drying chamber formed on one side thereof, means for supporting a slab gel formed for positioning in said drying chamber, said means for supporting contacting one side of the slab gel, whereby the other side is an exposed side, a cover for contacting said platen around the periphery of said drying chamber, means for heating said drying chamber, means for overlying the exposed side of the slab gel and in contact therewith, said means for overlying having a smooth nonporous surface thereby being nonadherent to the slab gel, and vacuum means in communication with said drying chamber for reducing the pressure therein relative to ambient pressure, whereby ambient pressure forces said cover against said platen thereby providing a peripheral seal for said drying chamber, so that when a wet slab gel is placed on said means for supporting, moisture vapor is removed thereform and from said drying chamber by said vacuum means and the slab gel is fixed on the means for supporting.

8. An apparatus as in claim 7 together with means for timing a predetermined period, and producing a timer output at the end thereof, a thermostat adjacent to said means for heating for controlling the temperature in said drying chamber during said predetermined period, said timer output being connected to interrupt said means for heating at the end of said predetermined period, thereby producing a preset drying time at a controlled temperature.

9. An apparatus as in claim 7 wherein said means for heating is electrically energized, together with a temperature sensor adjacent to the slab gel producing an output signal indicative of a dry slab gel circuit means having closed and open circuit conditions connected between said means for heating and an electical source, so that when the moisture in the slab gel is substantially all removed said output signal opens said circuit means and disconnects said means for heating from the electrical source.

10. An apparatus as in claim 7 wherein said means for supporting a slab gel comprises porous filter member for mounting the slab gel on said one side, and a screen underlying said porous filter member in contact therewith, said porous filter member operating to adhere to the dried slab gel and said screen supplying support to reduce fracture and distortion in the slab gel during drying.

11. An apparatus as in claim 7 together with means for exposing one side of said means for supporting t0 substantially uniform pressure thereacross, whereby slab gels are protected from fracture or distortion during drying.

* * * * *